US005813812A

United States Patent [19]

Moran et al.

[11] Patent Number: 5,813,812

[45] Date of Patent: Sep. 29, 1998

[54] APPARATUS FOR FORMING A SEAM

[75] Inventors: Peter Leslie Moran, Fairford; Adrian Kempster, Ramsey, both of United Kingdom

[73] Assignee: Carnaudmetalbox (Holdings) USA, Inc., Wilmington, Del.

[21] Appl. No.: 906,837

[22] Filed: Aug. 6, 1997

Related U.S. Application Data

[63] Continuation of Ser. No. 423,734, Apr. 18, 1995, abandoned.

[30] Foreign Application Priority Data

Apr. 20, 1994 [GB] United Kingdom ..... 9407793

[51] Int. Cl.[6] ..... B21D 51/32

[52] U.S. Cl. ..... 413/31; 279/102; 72/462

[58] Field of Search ..... 413/6, 31, 32, 413/33, 34, 35, 36, 37, 38, 39, 40; 279/102; 72/462

[56] References Cited

U.S. PATENT DOCUMENTS

| | | | |
|---|---|---|---|
| 4,268,569 | 5/1981 | Hale | 72/462 |
| 5,027,580 | 7/1991 | Hymes et al. . | |
| 5,095,730 | 3/1992 | Lauder | 72/462 |
| 5,477,722 | 12/1995 | Dziedzic | 72/462 |

FOREIGN PATENT DOCUMENTS

| | | |
|---|---|---|
| A2 0118201 | 12/1984 | European Pat. Off. . |
| 63-137525 | 11/1986 | Japan . |
| 63-212025 | 2/1987 | Japan . |
| 2098899 | 5/1981 | United Kingdom . |
| 2225265 | 10/1989 | United Kingdom . |

*Primary Examiner*—Kurt Rowan
*Attorney, Agent, or Firm*—Diller, Ramik & Wight, PC

[57] ABSTRACT

A chuck, for use in a machine forming a double seam joining a can body to an end wall of a can, has a hollow body portion 36 made of machinable material and an annulus 37 of harder material joined to the body portion to define a lower part of the side wall of the chuck. The annulus of harder material is preferably covered by an impervious continuous layer 38 of hard material such as titanium nitride, chromium carbide, iron boride or chromium boride.

14 Claims, 3 Drawing Sheets

APPARATUS FOR FORMING A SEAM

This application is a continuation of application Ser. No. 08/423,734, filed Apr. 18, 1995, now abandoned.

BACKGROUND OF THE INVENTION

This invention relates to apparatus for forming a rolled seam between an end wall and a side wall of a container body and more particularly but not exclusively to a chuck for supporting the end wall while a seam is formed progressively by a roll.

British Patent No. 2098899 describes apparatus for forming a double seam by means of a chuck engaged within a can end supported on the flange of a can body, while first and second operational rolls roll relative to the can end to sequentially interfold the flange and periphery of the can end to form a first operation seam and then the second roll flattens the seam.

Co-operating features of the chuck and rolls are described which facilitate correct setting of the chuck and rolls at the same level so reducing time lost during setting up of the apparatus.

British Patent No. 2225265 describes double seaming apparatus in which the seaming rolls are supported on ceramic balls in upper and lower bearings to achieve prolonged use with limited lubrication. The coating of seaming rolls with hard nitrides has increased the life of seaming rolls but the chucks still wear out of tolerable dimensions more rapidly than the rolls so that the full benefit of prolonged periods of use without replacement cost and lost time arising from better seaming rolls, is not completely achieved.

The chuck of a double seaming apparatus requires:

a). a correct end profile to centre and support the can end in the can body;

b). a machined bore through the chuck body to permit fixing to the apparatus; and c). a prolonged service life.

Hither to the manufacture of chucks has required laborious machining of hard metals, such as high chromium steel, to create the required shape, the hardness of the end profile being limited by the limitation to machinable materials. Problems may arise if materials comprising carbides in a metal matrix are used because such materials have the tendency to adhesive pickup of aluminium or lacquer of the can ends.

SUMMARY OF THE INVENTION

In order to overcome these problems this invention provides a chuck for holding an end wall of a container on a container body while a flange of the body and peripheral portion of the end wall are rolled into a seam, said chuck comprising a top wall, a bottom wall, a side wall extending from the bottom wall to the top wall and an aperture passing through the chuck from the top wall to the bottom wall, characterised in that, a body portion of machinable material defines the top wall, an upper part of the side wall and the aperture; and an annulus of harder material, bonded to the body portion, defines a lower part of the side wall including the work surface of the chuck.

On one embodiment the work surface of the chuck is covered by a coating of impervious hard material such as a vapour deposited coating of titanium nitride, or chromium carbide, a boride of iron or a boride of chromium.

In a preferred embodiment the side wall includes an annular wear surface, a groove above the wear surface, and a flange surface extending upwards from the groove to a shank surface.

If desired, the bottom wall of the chuck may define an outwardly concave cavity to accommodate a raised panel and lifting tab of an easy open can end.

The machinable body portion may be made of alloy steel such as EN58G or EN56A which are sulphur free. The annulus of harder material may be made of material comprising a carbide in a metal matrix.

Benefits arising from chucks, according to this invention, include prolonged chuck life and a reduction of time lost due to chuck replacement.

Various embodiments will now be described with reference to the accompanying drawings in which:

DESCRIPTION OF THE PREFERRED EMBODIMENTS

Figure 1:
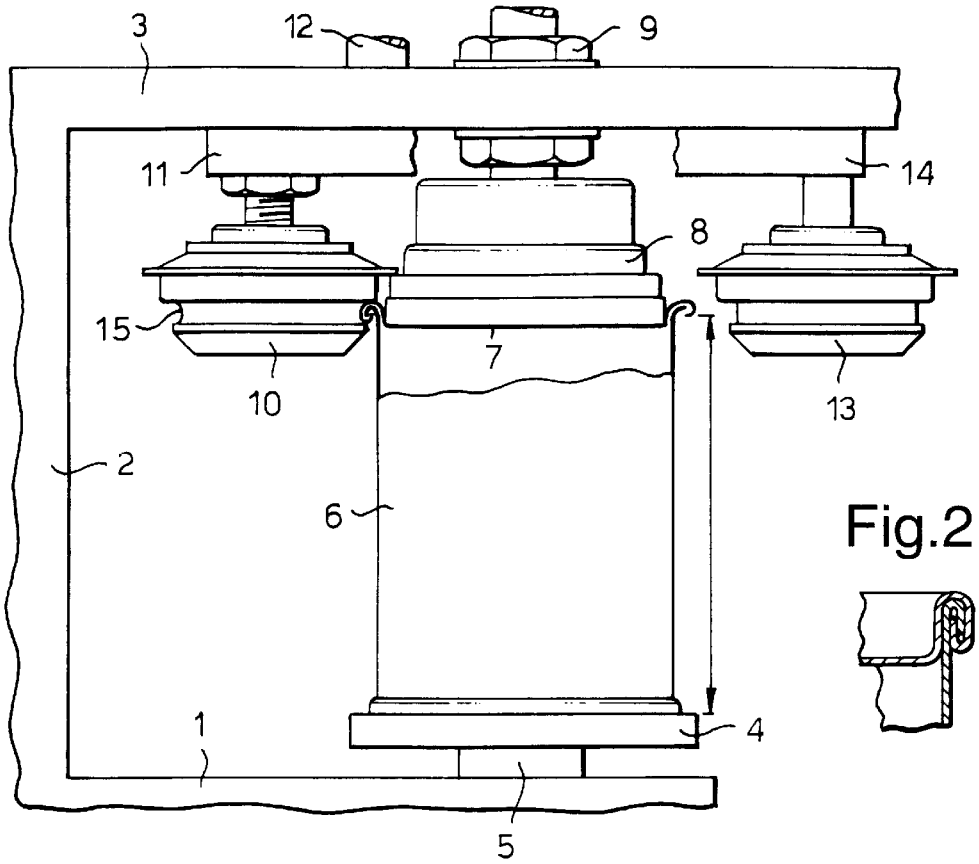
FIG. 1 is a diagrammatic sketch of apparatus for forming a double seam joining a can end to a can body.
Figure 2:
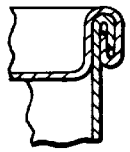
FIG. 2 is a fragmentary view of a section of a double seam.
Figure 3:
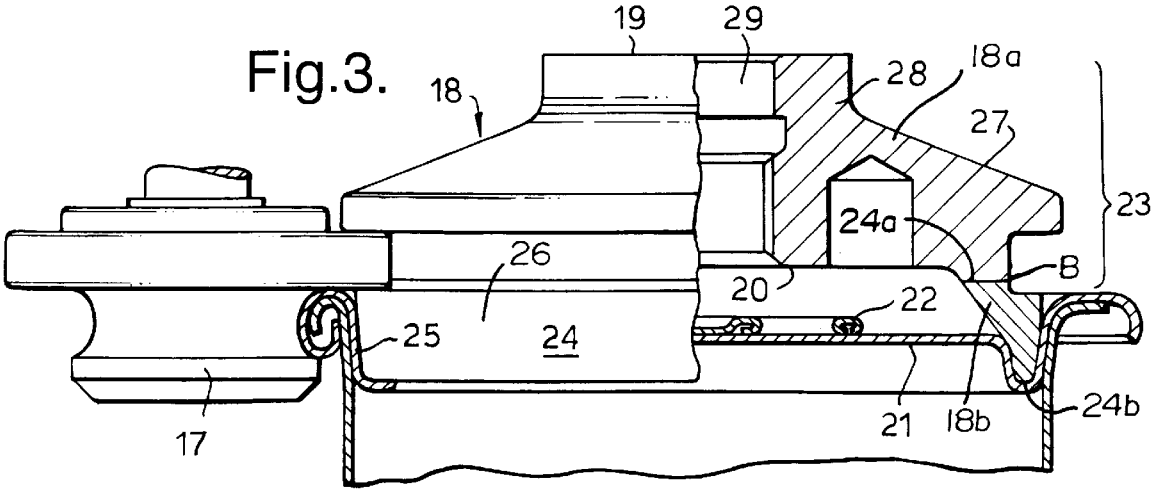
FIG. 3 is a side view of a first operation seaming roll and a cut-away chuck.

FIGS. 1, 2 and 3 permit discussion of problems arising during use of prior art seaming apparatus:

In FIG. 1 the can closing machine comprises a base plate 1, an upright portion 2 upstanding from the base plate 1 and a top plate 3 extending from the upright portion 2 across the base plate 1. A lifter pad 4, supported on a pillar 5, is movable towards and away from the base plate 1 to permit placement and lifting of a flanged can body 6 to engage with a can end 7.

In FIG. 1 the can end 7 and can body 6 are depicted immediately before the start of first operation seaming. A driven rotatable chuck 8 is engaged with the can end 7 and about to rotate in the bearing 9 on the top plate 3. This bearing 9 permits adjustment of the height "H" of the chuck above the lifter pad 4. However, the lifter pad movement permits further adjustment to achieve a controlled compressive load on the body and can end. A first operation seaming roll 10 is mounted on an arm 11 having a shaft 12 which pivots in the top plate 3 so that a cam (not shown) may urge the arm 11 to bring the roll 10 to bear on the can end 7 against the support of the chuck 8. A second operation roll 13 is mounted on a pivotally mounted arm 14 operably engageable with a cam (not shown) which urges the second operation roll to compress the interfolded metal created by co-operation of the first operation roll and chuck.

FIG. 2 shows the flattened seam 16 created by the co-operation of the second operation roll 13 and chuck 8.

As the lifter 4 rises to lift the can body, the can end engages the periphery of the chuck so imposing abrasive wear on the chuck. The lifter pad is raised sufficiently to impose a compressive axial load, on the can end 7 and can body 6, in order to prevent any skidding of the can end on the flange of the can body so a repetitive axial load is imposed on the chuck which is expected to survive many thousands of seaming cycles. As the first and second operation rolls move inwards to form the double seam the chuck is subjected to radial force which it must be stiff enough to resist otherwise dimensional accuracy of the seam would become uncertain.

Whilst the chucks and rolls of apparatus used in can making factories work in a dry environment, the chucks and rolls in can packing factories are often subjected to a wet environment which may be acidic so that wear-resistant metal matrix materials may fail because the matrix material leaches out to leave loose carbide particles giving rise to loss of chuck shape.

FIG. 3 shows a first operation roll 17 co-operating with a first embodiment of a chuck 18 according to this invention during formation of a first operation seam.

In FIG. 3 the chuck 18 comprises a pair of first and second chuck bodies 18*a*, 18*b*, respectively. The first chuck body 18*a* includes a top wall or surface 19, and a bottom surface 20 defining a cavity to accommodate the raised central panel of a tear open can end 21 and its lifting tab 22. The top and bottom surfaces (19, 20, respectively are joined by a side surface 23. The second chuck body 18*b* includes a top surface or top wall 24*a*, a bottom surface or bottom wall 24*b* and a side wall or an annular work surface 24 surrounded by the chuck wall 25 of the can end. An annular groove 26 is disposed above the work surface 24 and, a flange surface 27 slopes upwards from the groove 26 to a shank surface 28. The groove 26 is used during setting of the rolls and chuck. A central aperture 29 extends from the top surface 19 through to the bottom surface 20. The aperture 29 has surface features machined in it to receive chuck supporting members such as are indicated in FIG. 1.

Therefore the material of the upper part of the chuck has to be readily machinable whilst the annular work surface has to be stiff and resistant to hostile working environments. As shown in FIG. 3 the upper chuck body 18*a* defined by the top surface 19 and side surface portions 28,27,26 is made of a machinable metal such as mild steel or alloy steel EN58G or ENS6A. The lower chuck body 18*b* is made of a material comprising carbide particles in a metal matrix suitable for the expected working conditions.

The upper and lower to chuck bodies 18*a*, 18*b*, respectively, and are joined by bonding means B of any one of known bonding processes such as:

electron beam welding, brazing, friction welding, diffusion bonding, shrink fitting or push fit of co-operating tapered surfaces of the upper part and harder lower part.

Figure 4:
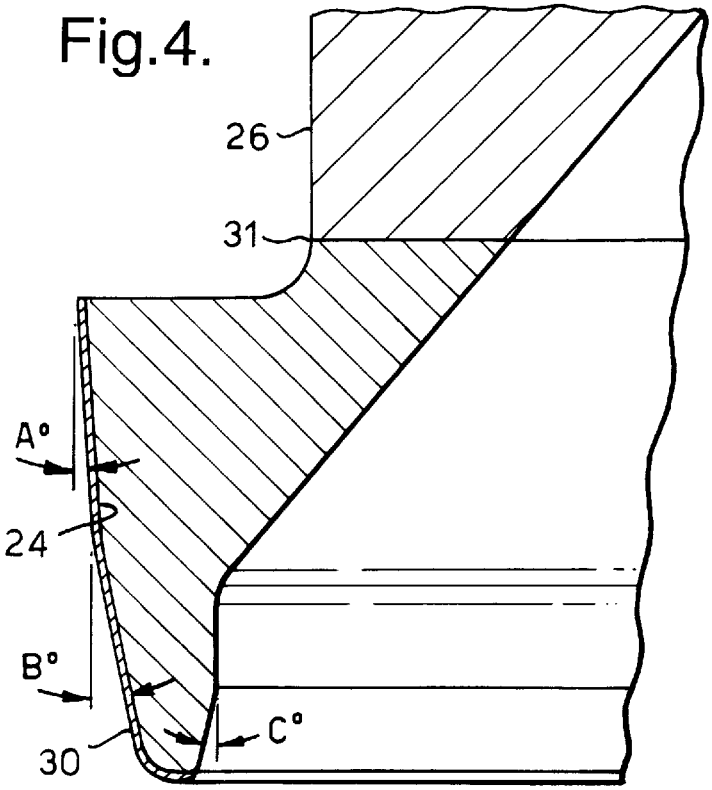
FIG. 4 is an enlarged fragmentary view showing a first configuration of the bond between a chuck body and hard annulus.

FIG. 4 shows a second embodiment of the chuck in which like parts are indicated by the same part numbers as used in FIG. 3. The chuck shown in FIG. 4 has an upper part made of EN58G and a lower part made of a cemented carbide tool material such as that sold under the trade name STELLITE 1 (Trade Mark) by DELORO STELLITE of Swindon UK. STELLITE 1 comprises carbides in a cobalt base or matrix. In order to prevent pick-up of aluminium or lacquer from the can ends the peripheral wear surface of the chuck is covered by a vapour deposited coating 30 of titanium nitride. The coating 30 extends around the lower extremity of the hard annulus 24. In FIG. 4 the bond 31 extends horizontally between the hard annulus and upper cart of the chuck. Whilst a brazed bond will suffice for lightly loaded chucks it may be preferable to form the bond by diffusion bonding through a thin layer of nickel or titanium as is described in British Patent No 2222543 to which the reader is directed for further information.

Figure 5:
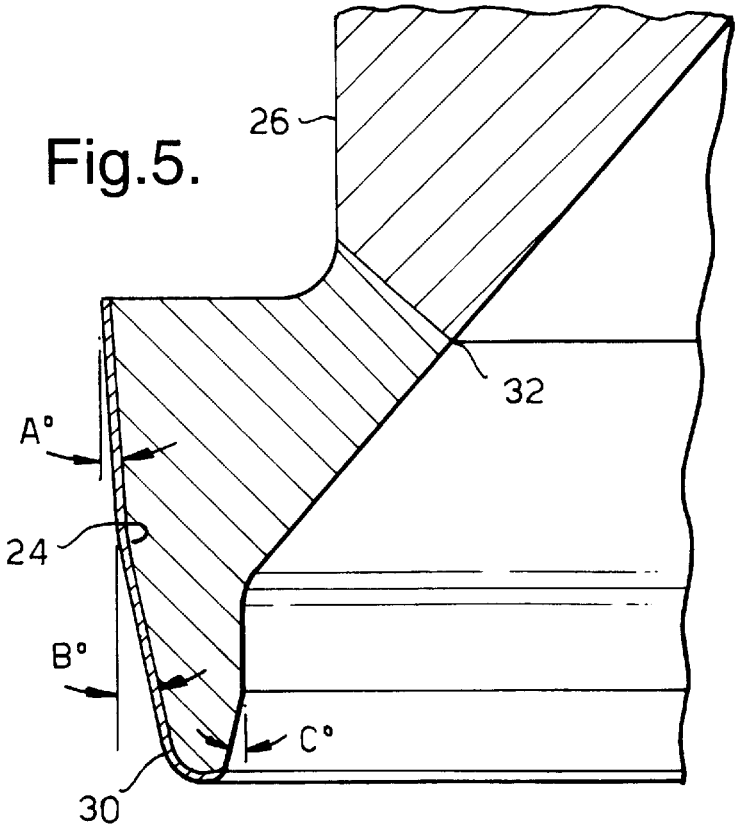
FIG. 5 is an enlarged fragmentary view of showing an alternative bond configuration between a chuck body and hard annulus.

FIG. 5 shows an alternative chuck for heavier loading. In FIG. 5 the bond 32 extends at an angle of about 45° to an axis passing through the centre of the chuck aperture so that both radially applied force from the seaming rolls and axial load received from the lifter pad impose a compressive force on the bond. As already described, a layer 30 of titanium nitride covers the periphery of the harder lower part 34 of this chuck. Typically the coating or layer 30 of titanium nitride is between 5 to 10 microns thick. The desired layer of titanium nitride may be made by reaction of titanium tetrachloride and nitrogen under suitable conditions. As the vapour deposition process is not limited to "line of sight" the bottom wall cavity may be coated if necessary.

Figure 6:
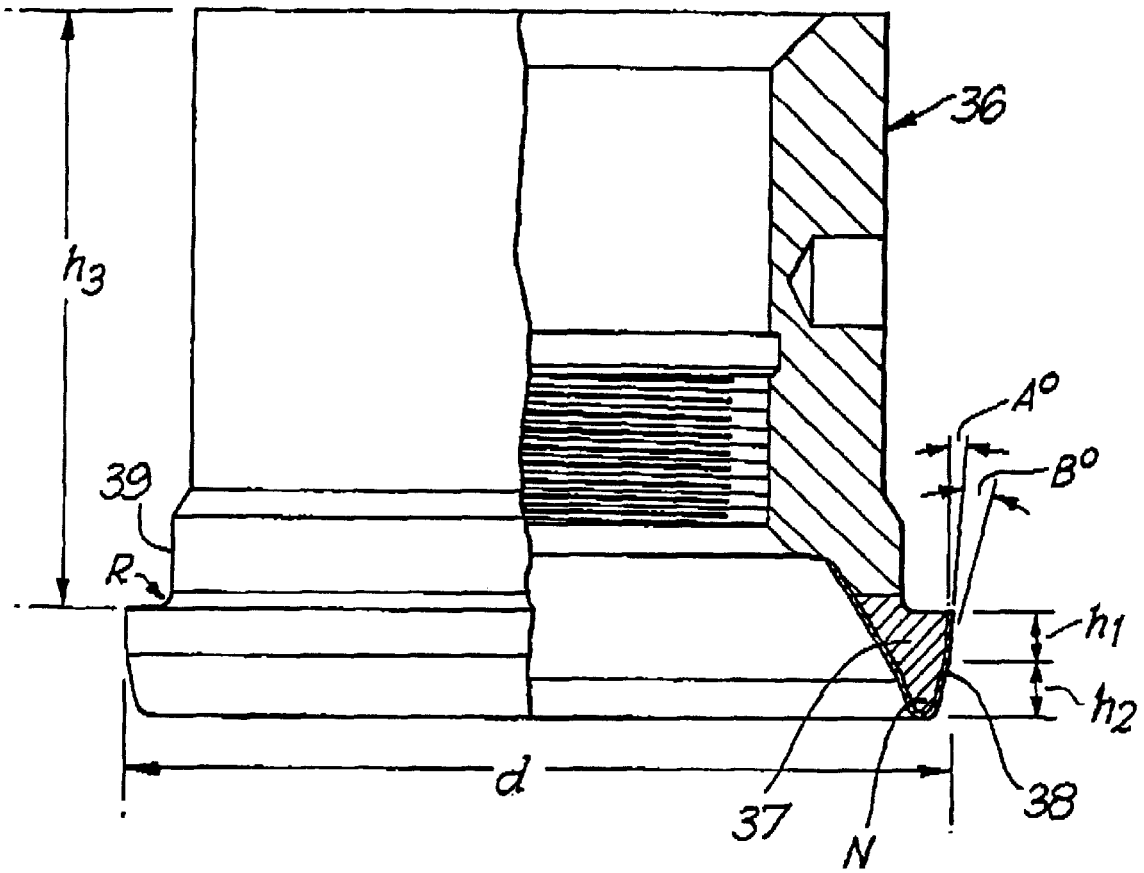
FIG. 6 is a cut-away side view of an further embodiment of a chuck according to the invention.

FIG. 6 shows another embodiment of the chuck comprising a hollow shank portion 36 made of a readily machinable metal, an annulus 37 of harder material bonded to the bottom surface of the shank portion, and a chemically vapour deposited (CVD) coating 38 of carbide which covers substantially the whole exposed surface of the harder material.

In FIG. 6 the shank portion 36 is wider "d" and taller h3 than that shown in FIG. 3 so that bearings of larger diameter can be accommodated. The annular groove of FIG. 3 is replaced in FIG. 5 by a cylindrical portion 39 joining the top surface of the hard material annulus 37 in a radius R.

The peripheral work surface of the CVD coated hard material comprises an annulus of compound arcuate cross section N a first taper surface extending upwards a height h2 from the annulus at an angle B° to die central chuck axis, to a second taper surface of height h1 extending at an angle A° to the chuck axis. Typical dimensions for a chuck used to seam 202 diameter can ends to a beverage can are:

"R"=0.030"
A°=4°
h1=0.130"
B°=12°
h2=0.120"
d=2.2167"
h3=1.626"
N=0.020" outer/0.010" inner radius Whilst this invention has been described in terms of chucks used for forming double seam between a beverage can end having a peripheral channel portion into which the annulus coated hard material fits, it is also within the scope of this invention to modify the shape of the hard material annulus to fit can ends having a flat centre panel spanning the chuck wall. In which case the hard material may be in the form of a flat faced annulus bonded to the machinable metal of the shank portion. In this case when the width of hard material is not limited by the width of can end channel. The shank portion may have a protruding spigot on which the hard annulus is centered during bonding.

In the embodiments described, the annulus of hard material is bonded to the shank material at a position close to the top of the peripheral work surface. This bond position minimises the amount of hard material required for the annulus. However a bond position higher up in the shank material may give a greater bond area if required For extra strength.

Although a preferred embodiment of the invention has been specifically illustrated and described herein, it is to be understood that minor variations may be made in the apparatus without departing from the spirit and scope of the invention, as defined the appended claims.

We claim:

1. A chuck for holding the end wall of a container on a container body while a flange of the body and a peripheral portion of the end wall are rolled into a seam comprising a pair of first and second chuck bodies; said first chuck body including a top wall and a bottom wall, an aperture opening through said top and bottom walls, inner and outer side walls between said top wall and said bottom wall; said first chuck body being formed from substantially readily machinable material, said first chuck body being of a substantially annular configuration; said second chuck body being formed from material substantially harder than the material of said first chuck body; said second chuck body including a top wall, a bottom wall and inner and outer side walls between said second chuck body top and bottom walls; said second chuck body being of a substantially annular con figuration with said inner and outer side walls being in relatively downwardly converging relationship to said second chuck body bottom wall, means for bonding said first chuck body bottom wall to said second chuck body top wall to define a unitized chuck, said second chuck body outer side wall having an exterior thin continuous layer of impervious hard material defining an exterior working surface of said chuck, and said first chuck body inner and outer side walls merge in substantially uni-planar relationship with said second chuck body respective inner and outer side walls.

2. The chuck as defined in claim 1 wherein said impervious hard material layer is a vapour deposited coating.

3. The chuck as defined in claim 1 wherein said impervious hard material layer is a vapour deposited coating of titanium nitride, chromium carbide, an iron boride or a chromium boride.

4. The chuck as defined in claim 1 wherein said first and second chuck body outer side walls collectively define a radially outwardly opening annular channel adapted to receive therein a rib of an associated flange-forming roll.

5. The chuck as defined in claim 1 wherein said substantially annular second chuck body inner side wall defines a cavity in conjunction with said first chuck body bottom wall.

6. The chuck as defined in claim 1 wherein the material of said first chuck body is a tool steel.

7. The chuck as defined in claim 1 wherein said substantially annular second chuck body material includes carbide in a metal matrix.

8. The chuck as defined in claim 2 wherein said first and second chuck body outer side walls collectively define a radially outwardly opening annular channel adapted to receive therein a rib of an associated flange-forming roll.

9. The chuck as defined in claim 1 wherein said substantially annular second chuck body inner side wall defines a cavity in conjunction with said first chuck body bottom wall.

10. The chuck as defined in claim 4 wherein said substantially annular second chuck body inner side wall defines a cavity in conjunction with said first chuck body bottom wall.

11. The chuck as defined in claim 10 wherein said impervious hard material layer is a vapour deposited coating.

12. The chuck as defined in claim 10 wherein said impervious hard material layer is a vapour deposited coating of titanium nitride, chromium carbide, an iron boride or a chromium boride.

13. The chuck as defined in claim 10 wherein the material of said first chuck body is a tool steel.

14. The chuck as defined in claim 10 wherein said substantially annular second chuck body material includes carbide in a metal matrix.

* * * * *